United States Patent [19]

Heyrana

[11] 4,143,254

[45] Mar. 6, 1979

[54] WATERPROOF MULTIPLE ELECTRICAL SWITCH ASSEMBLY

[76] Inventor: Pablo M. Heyrana, 1839 R St. NW., Washington, D.C. 20009

[21] Appl. No.: 790,418

[22] Filed: Apr. 25, 1977

[51] Int. Cl.[2] ..... H01H 15/00; H01H 9/00

[52] U.S. Cl. ..... 200/16 R; 200/16 B; 200/17 R; 200/47; 200/153 LA; 200/153 T; 200/245; 200/302

[58] Field of Search ..... 200/38 E, 61.53, 30 R, 200/27 R, 294, 296, 153 L, 153 LA, 153 T, 302, 47, 238, 245, 246, 247, 250, 251, 276, 283, 284, 16 R, 16 B, 17

[56] References Cited

U.S. PATENT DOCUMENTS

| | | | |
|---|---|---|---|
| 2,591,684 | 4/1952 | Deakin | 200/246 |
| 2,691,081 | 10/1954 | Weber | 200/153 T X |
| 2,875,287 | 2/1959 | Van Sickle | 200/153 T X |
| 2,912,532 | 11/1959 | Jennings | 200/153 |
| 2,943,170 | 6/1960 | Vradenburgh | 200/245 X |
| 3,038,973 | 6/1962 | Alpert | 200/61.53 X |
| 3,192,349 | 6/1965 | Horberg, Jr. | 200/153 LA |
| 3,193,630 | 7/1965 | Shlesinger, Jr. | 200/16 B |
| 3,211,154 | 10/1965 | Becker et al. | 200/16 B |
| 3,286,046 | 11/1966 | Mincone | 200/17 R X |
| 3,472,977 | 10/1969 | Ziegler, Jr. | 200/153 LA X |
| 3,525,060 | 8/1970 | Scheidig | 200/283 X |
| 3,566,051 | 2/1971 | Hulterstrum et al. | 200/18 X |
| 3,586,805 | 6/1971 | Ziegler, Jr. | 200/38 E X |
| 3,979,571 | 9/1976 | Van Benschoten | 200/276 X |

*Primary Examiner*—James R. Scott

*Attorney, Agent, or Firm*—Shlesinger, Arkwright, Garvey & Dinsmore

[57] ABSTRACT

A programmable, reciprocating, multiple electrical switch assembly contained within a waterproof housing. The assembly includes a plurality of discrete electrical switches arranged in a predetermined pattern on a fixed frame. The switches are triggered by projections strategically arranged on a sliding key-like finger which mates with the interior of the frame.

25 Claims, 15 Drawing Figures

WATERPROOF MULTIPLE ELECTRICAL SWITCH ASSEMBLY

SUMMARY OF THE INVENTION

The switch assembly of the present invention is particularly adapted for controlling the operation of electrical equipment in any environment. To accomplish this purpose, the electrical components are contained within a housing which is sealed to prevent water, dust, chemicals or other foreign materials from entering the assembly. The assembly is programmable in that the sequence of activation of equipment to be controlled can be altered to suit the requirements of the user so that the controller and the equipment to be controlled can be placed together at a hostile or difficult to reach site.

The assembly includes a plurality of switches fixed on a frame, which switches are provided with levers which are activated by an electrically neutral reciprocating finger on the periphery of which are arranged triggering humps which are strategically positioned to actuate the switch levers. The arrangement and size of the triggering humps on the exterior surface are totally at the discretion of the user depending upon the desired result to be obtained. The sliding key-like finger is engaged with a plunger arm extending through the switch housing, which switch arm may be manually or mechanically operated to effect the desired actuation of the switches.

DESCRIPTION OF THE INVENTION

Figure 1:
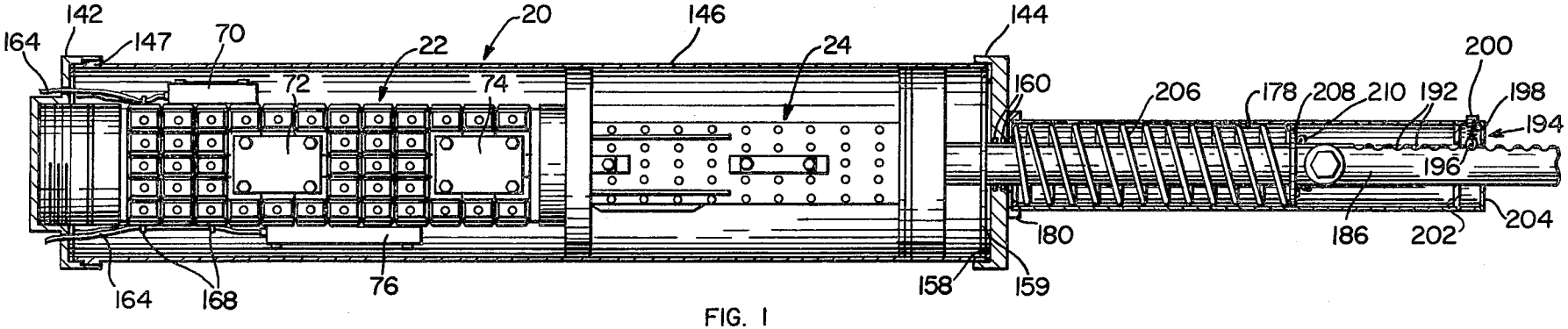
FIG. 1 is a longitudinal sectional view of the multiple electrical switching assembly of the present invention, showing the same in inoperative position, portions thereof being shown in elevation.

As shown in FIG. 1, the assembly of the present invention includes an outer housing 20, an intermediate frame 22 and a sliding key-like finger 24. Frame 22 is fixed within housing 20 while finger 24 slides in and out of the interior of the frame, remaining at all times within the housing. Finger 24 is connected to a plunger arm 26 which extends through the housing. By reciprocating plunger arm 26, finger 24 slides in and out of frame 22.

Figure 5:
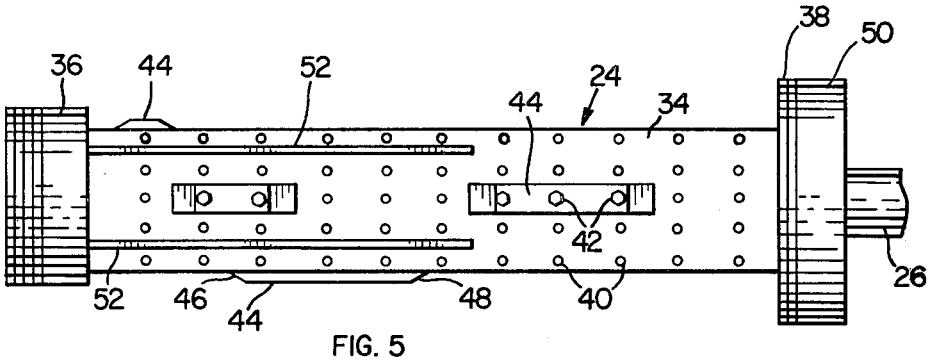
FIG. 5 is a side elevational view of the sliding key-like finger forming a part of the present assembly.
Figure 6:
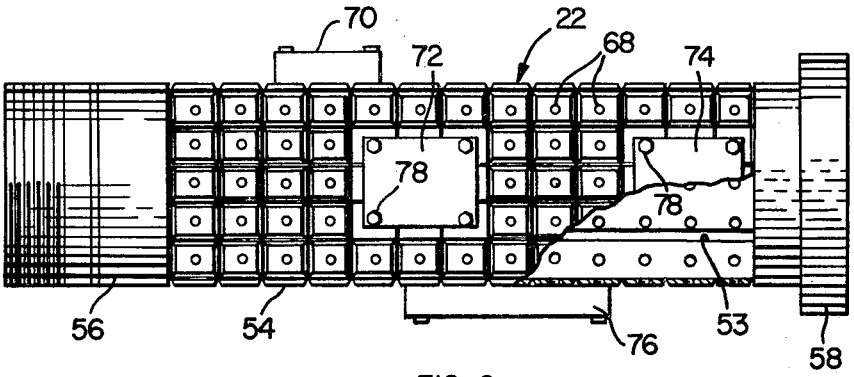
FIG. 6 is a side elevational view of the intermediate frame forming a part of the present invention.

Referring to FIG. 5, sliding key-like finger 24 includes a cylindrical body portion 34, a front disk-like cushion 36 and a rear cushion 38. Body portion 34 is preferably made of a non-ferrous material such as plastic, mica or bakelite. The periphery of the body portion is provided with a plurality of regularly spaced mounting holes 40 adapted to receive mounting screws 42, which mounting screws are employed to secure triggering humps 44 to the peripheral surface of the finger.

Humps 44 are preferably made of non-ferrous material and may be of any desired length or width but the depth thereof is determined by the lateral distance between the frame and the finger. As shown in FIG. 5, humps 44 are preferably of elongated, generally rectangular, conformation of standard width and depth and variable length. The forward portion 46 and the rear portion 48 of each hump 44 are tapered down to the surface of the finger. The humps are removably attached to the finger by one or more mounting screws 42 counter-sunk into the flat contact surface of the hump, which screws thread into mounting holes 40 in the finger. Optionally, the humps may be glued to the periphery of body portion 34.

The front disk-like cushion 36 is made of resilient material such as rubber, to protect the finger from extreme impact against the end wall of the housing. Similarly, at the opposite end of the finger, rear cushion 38, also of resilient material, softens impact against intermediate frame 22. Cushion 38 is attached to a rear stopper 50 which abuts against the housing when the finger is fully withdrawn.

Alignment of sliding finger 24 with respect to intermediate frame 22 is maintained by a plurality of spaced, longitudinally extending guide fins 52, which fins are fixed to the entire periphery of the finger at spaced intervals and are adapted to slide within longitudinal channels 53 on the interior surface of frame 22.

Figure 7:
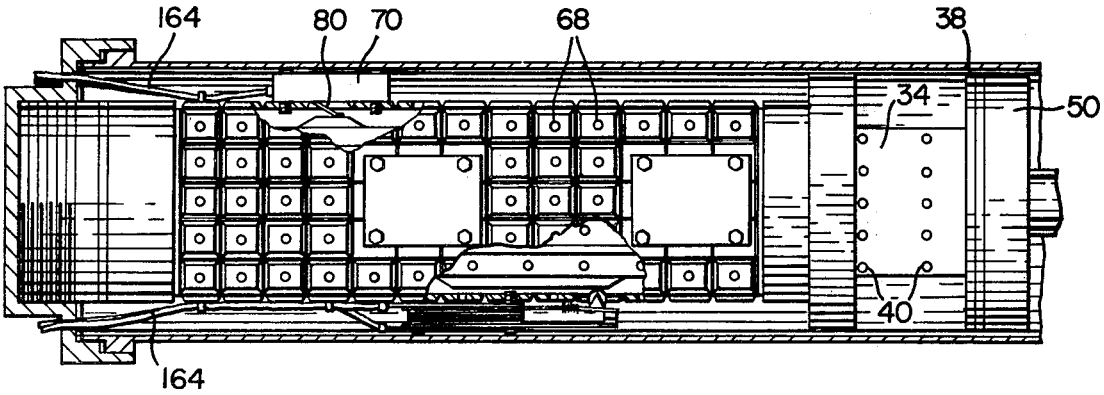
FIG. 7 is a fragmentary longitudinal sectional view of the switching assembly, showing the key-like finger partially extended into the frame, portions thereof being broken away and shown in the elevation.
Figure 8:
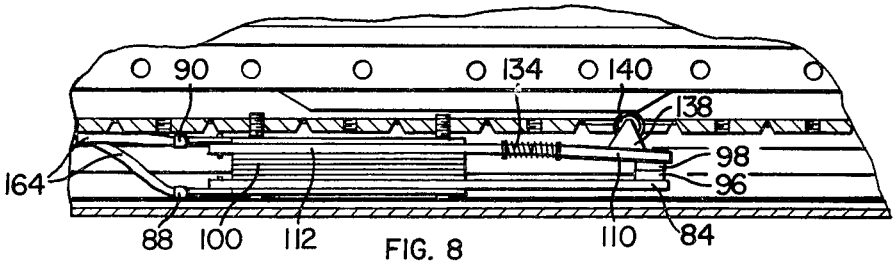
FIG. 8 is an enlarged sectional view of the portion of the assembly illustrated in FIG. 7, and showing to advantage the blade switch forming a part of the present invention.

Key-like finger 24 slides in and out of intermediate frame 22 as shown in FIG. 7. The frame is generally of tubular shape, approximating the shape of the sliding finger, and comprises a main central switch section generally designated 54, a threaded end 56 and a stopper 58.

Figure 14:
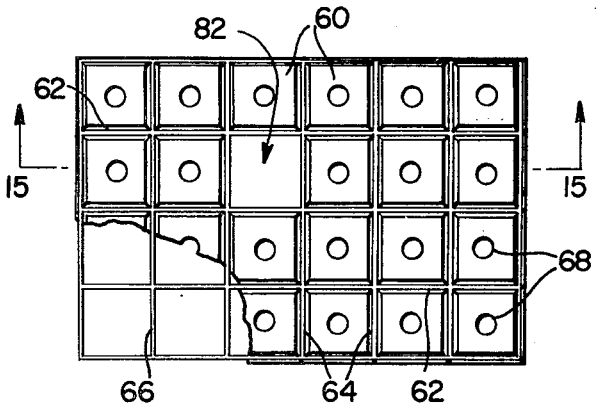
FIG. 14 is a plan view of a sheet employed in forming a portion of the frame of the present invention.
Figure 15:
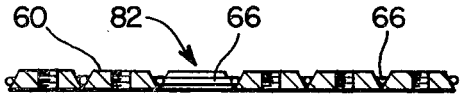
FIG. 15 is a sectional view taken along the line 15—15 of FIG. 14, looking in the direction of the arrows.

Switch section 54 is constructed from a waffle-like sheet, shown to advantage in FIGS. 14 and 15. The waffle-like sheet includes a plurality of rectangular zones 60 formed by cutting a plurality of longitudinal and transverse notches in the sheet, which is preferably of a non-conducting material such as plastic, mica or bakelite. This provides longitudinal weakened zones 62 and transverse weakened zones 64. A screen or grid 66, preferably made of metal, fits over the waffle-like sheet and into the weakened zones where it can be glued in place. Threaded mounting holes 68 are centrally located in each zone 60 and the sheet is formed into a tubular shape, following which threaded end 56 and stopper 58 are connected to the ends thereof.

A plurality of switches indicated at 70, 72, 74 and 76 are mounted on main central switch section 54 by bolts 78 which screw into mounting holes 68. As shown in FIG. 7, switch 70 is a conventional microswitch having a triggering lever 80 which extends through an opening formed in main central switch section 54 by knocking out one of the rectangular zones 60. In accordance with the present invention, switch 70 may be positioned by first punching out the selected rectangular zone 60 to form opening 82 as shown in FIGS. 14 and 15. This can be accomplished by means of a blunt instrument which causes the rectangular zone to break away along adjacent weakened zones 62 and 64. Knocking out of the rectangular zone does not affect the adjacent zones since grid 66 provides sufficient structural rigidity so that only one zone at a time can be removed.

The switch housing is next aligned with the intermediate frame 22 so that triggering lever 80 passes through opening 82 created by the removal of the rectangular zone. The switch housing can then be screwed into position with bolts 78 which extend through openings in the microswitch housing into threaded mounting holes 68.

As shown in FIG. 7, as the finger 24 reciprocates within frame 22, triggering hump 44 causes triggering lever 80 to be activated. More specifically, as the triggering hump approaches switch lever 80, the tapered hump end 42 engages the lever, causing it to move upwardly. The arm is maintained in the upward position by the lever main body portion of the hump and the arm is slowly lowered by the rear tapered end 44 of the hump. The deflection of the lever arm by the hump causes the switch to turn "on" or "off" for a period of time related to the length of the hump and the speed at which it is moving. After the hump has passed, the lever springs back into its original position and the switch returns to its original state.

It is within the contemplation of the present invention to employ a variety of switches. In low current applications, a conventional microswitch 20, illustrated in FIG. 7, may be utilized. For larger current requirements, a special blade switch 76 may be used.

Blade switch 76 forms a salient part of the present invention and is illustrated to advantage in FIGS. 8 to 12. The switch comprises an upper contact leaf 84 and a lower contact leaf 86. Leaf 84 is connected to electrical terminal 88 while leaf 86 is connected to electrical terminal 90. The terminals are hollow metal tubes with an open end to receive an electrical contact and a closed end connected to pieces 92 and 94 respectively, which bolt to the end of contact leaves 84 and 86. On the opposite ends of the contact leaves, circular contacts 96 and 98 are provided in facing relationship.

At a point near the terminals thereof, leaves 84 and 86 are separated by an insulator 100. Bolts 102 separated from the surface of contact 86 by insulator 104, and nuts 106 separated from contact leaf 84 by insulator 108, clamp the arms on the insulator. Insulator 100 preferably comprises a series of stacked, rectangular leaves. If desired, bolts 102 and nuts 106 may be made of an insulating material such as nylon.

Figure 10:
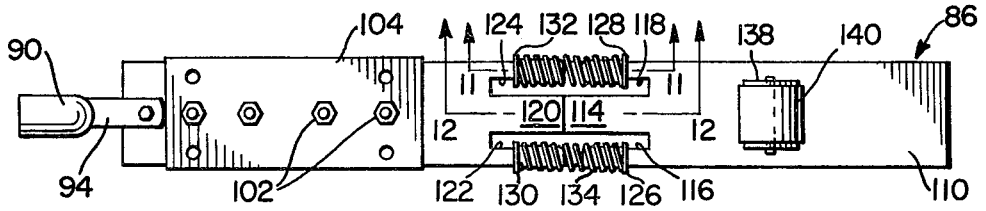
FIG. 10 is a bottom plan view of the same.

As shown to advantage in FIG. 10, lower contact leaf 86 comprises two portions, a movable contact portion 110 and a fixed terminal portion 112. The end of portion 110 proximate portion 112 includes three spaced prongs, a central prong 114 and lateral prongs 116 and 118. The end of portion 112 proximate portion 110 also includes three spaced prongs, a central prong 120 and lateral prongs 122 and 124.

The ends of prongs 114 and 120 are extended to provide interfitting curved portions 115 and 121 which forms a hinge in order to permit relative movement of movable contact portion 110 with respect to fixed terminal portion 112 in a direction to effect engagement of contacts 96 and 98.

Figure 9:
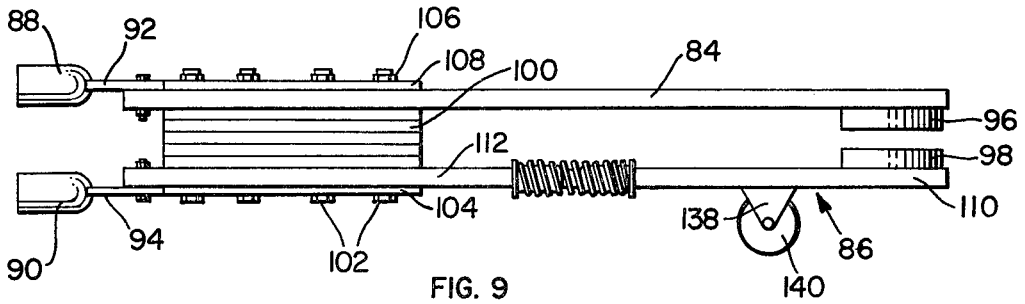
FIG. 9 is a side elevational view of the blade switch forming a part of the present invention.
Figure 11:
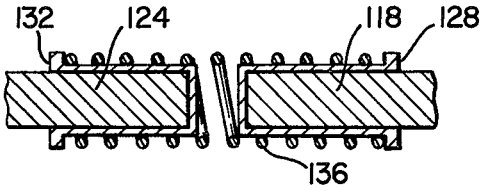
FIG. 11 is a sectional view taken along the line 11—11 of FIG. 10, looking in the direction of the arrows.

Referring to FIGS. 9, 10, and 11, the opposed ends of prongs 116 and 122, and the opposed ends of prongs 118 and 124, are slightly spaced apart and flanged insulating jacks 126, 128, 130 and 132 are positioned over prongs 116, 118, 122 and 124 respectively. A pair of helical springs 134 and 136 extend between opposed pairs of lateral prongs, the springs being positioned over the insulating jackets with the terminals of the springs engaging the flanges of the jackets. More specifically, one end of helical spring 134 is placed over insulating jacket 126 and the other end over insulating jacket 130. One end of helical spring 136 is placed over insulating jacket 128 and the other end over insulating jacket 132. The insulating jackets serve to prevent direct engagement of the springs with lower contact leaf 86, and prevent deterioration of the springs which would otherwise result when electricity passes through the switch.

Figure 12:
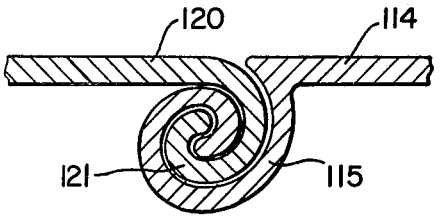
FIG. 12 is a sectional view taken along the line 12—12 of FIG. 10, looking in the direction of the arrows.
Figure 13:
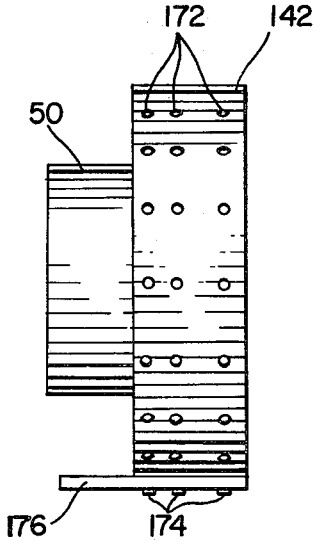
FIG. 13 is a side elevational view of a second end cap forming a part of the present invention.

The hinge formed by curved portions 126 and 128, shown in FIG. 12, is a locking hinge which allows contact portion 110 to freely bend towards contact leaf 184. However, the hinge locks in such a manner that movable contact portion 110 will not bend in a direction away from contact leaf 86 past the contact portion's undeflected position.

The outer face of movable contact portion 110 is provided with a mounting bracket 138 which rotatably supports a roller 140 which passes through intermediate frame 22 for engagement with a triggering hump 44 on finger 24 which is aligned with the roller.

In use, springs 134 and 136 serve to urge portions 110 and 112 together to insure good electrical connection at the hinge and additionally serve to normally retain movable contact portion 110 in its undeflected position until such time as roller 140 is in engagement with a triggering hump.

Outer housing 20 may be of metallic and/or plastic construction and comprises end caps 142 and 144 which are engaged with the terminals of a substantially tubular enclosure 146. An annular threaded land or flange 147 is located on the outer periphery of the tubular enclosure near one end thereof. The enclosure may be of opaque material but is preferably transparent so that the user can observe the interior of the switch assembly. End cap 142 is provided with internal threads 148 for threaded engagement with threaded annular land or flange 147. Cap 142 is further provided with a central hub portion 150 of reduced size, which hub portion has internal threads 152 for engagement with threaded end 56 of frame 22. Sealing gaskets are indicated at 154 and 156. The forward end of enclosure 146 abuts gasket 156 and land 147 engages gasket 154 to effect a waterproof seal. End cap 144 is provided with a sealing gasket 158 for engagement with the opposite end of enclosure 146 and with O-rings 160 which engage the periphery of plunger arm 26 to effect a waterproof seal. A cushion gasket 159 is mounted in end cap 144 against which rear stopper 50 impacts.

Figure 3:
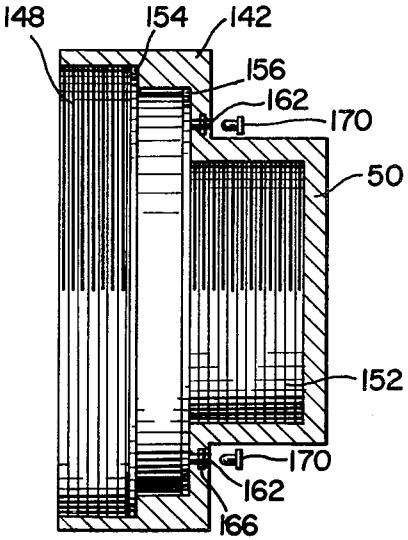
FIG. 3 is a sectional view taken along the line 3—3 of FIG. 2, looking in the direction of the arrows.
Figure 2:
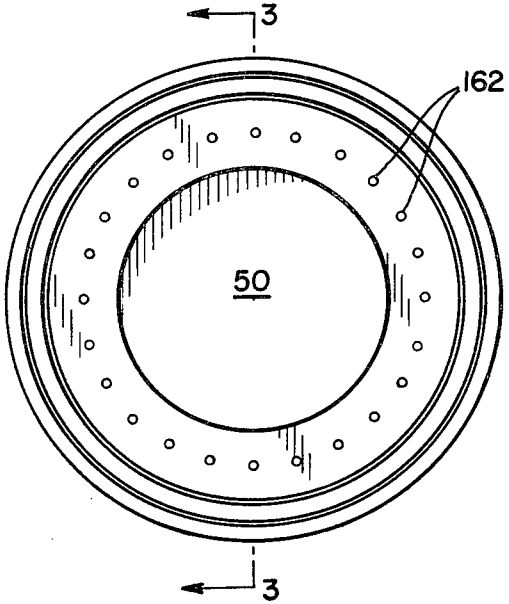
FIG. 2 is an enlarged view of an end cap forming a part of the present invention.

As illustrated in FIGS. 2 and 3, end cap 146 is provided with a plurality of circumferentially arranged electrical ducts 162 through which electrical wires 164 and fed to the switches. Each duck is provided with an O-ring 166 so that when wires 164 are fed therethrough, a waterproof seal is effected. Clips 168 are provided for holding the wires flat against frame 22. Ducts which do not contain wires are closed by rubber plugs 170.

In the event that it is desired to mount the present switching assembly on a wall or other structure, end caps may be provided with a plurality of circumferentially spaced holes 172 which are transversely aligned and adapted for threaded engagement with bolts 174 which are carried by a mounting bracket 176. End cap 144 may also be provided with similar peripheral openings for selected reception of bolts carried by a mounting bracket.

Figure 4:
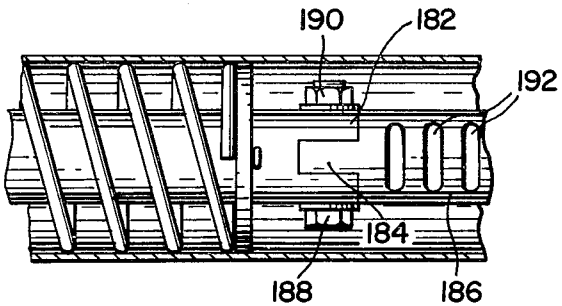
FIG. 4 is an enlarged fragmentary, longitudinal sectional view of a portion of the plunger arm forming a part of the present invention.

Referring now to FIGS. 1 and 4, it will be seen that plunger arm 26 extends through the end wall of housing 20 and through and beyond a plunger casing 178. Casing 178 may be threaded into a holding plate 180 which is welded or secured in any other suitable manner to end cap 144. An end of plunger arm 26 is U-shaped as indicated at 182 and the U-shaped portion is adapted to receive a complemental extension member 184 of an extension rod 186, U-shaped end 182 and extension 184 being held together by a bolt 188 and nut 190. Extension rod 186 is provided with a plurality of equally spaced transverse grooves 192 cut into the upper periphery thereof. In cooperation with grooves 192, there is provided a detent 194 in which is located a ball bearing 196 which is normally urged into a selected groove 192 by a coil spring 198. Cap bolt 200 is threadedly engaged with detent 194 for forcing spring 198 against ball bearing 196. Ball bearing 196 rides in and out of the grooves 192 as the extension rod 186 is slid passed the detent. Detent 196 may be formed by providing an annular member 202 which is in predetermined spaced relation to end wall 204 of plunger casing 178. Bolt 200 is preferably a stud bolt which threads through that portion of casing 178 which forms the detent so that the degree of extension of the bolt through the casing determines the compression of spring 198, which in turn sets the force that pushes ball bearing 196 into grooves 192. Plunger arm 26 is surrounded by a convolute biasing spring 106 which extends between holding plate 180 and a washer 208. Washer 208 is held in position against longitudinal movement by a cotter pin 210 which extends through plunger arm 26. Biasing spring 206 serves to return key-like finger 24 to which the plunger arm is connected to an inoperative position.

OPERATION

In use of the assembly of the present invention, the desired switching sequence is first of all determined and the programmer arranges triggering humps 44 on sliding finger 24 and positions the switches such as 70, 72, 74 and 76 on the main central switch section 54. The switching sequence may include either a constant or a variable operation.

The programmer next sets the tension on stud bolt 200 so that the desired tension is produced between ball bearing 196 and grooves 192. If unresisted movement of plunger arm 26 and extension rod 186 is desired, then stud bolt 200 may be removed.

On the other hand, if a fixed operation is desired, the sliding finger 24 is positioned within intermediate casing 22 and stud bolt 200 tightened at the desired point. However, if continuous switching is desired, bolt 200 is loosened so that a ratcheting effect is created. By having the distance between adjacent grooves 192 correspond to the distance between mounting holes 40 on sliding finger 24, extension rod 186 can be operated to achieve sequenced switching. This is carried out by moving sliding finger 24 in and out of intermediate frame 22 at a programmed rate and in a determined sequence. The correspondence between the grooves and the mounting holes allows the user to determine the alignment of switches and triggering humps inside the intermediate frame. The extension rod can then be connected to any suitable reciprocating activator such as a foot pedal, a leverage timing rod or even a simple hand knob.

Extension rod 186 is activated by the external source of reciprocation or is fixed by using the locatable detent. Movement of the extension rod causes the finger to slide within the frame with the result that the triggering humps 44 activate levers 80 or effect closure of contacts 96 and 98, thereby causing the electrical state of the switch to be changed.

With the assembly of the present invention, a switching assembly is provided which is protected from outer elements and foreign materials, which assembly is readily adaptable for different purposes. The assembly is also readily programmable so that the controller and equipment to be controlled can be placed together at a hostile or hard to reach site. This decreases the amount of cable needed to connect the equipment sought to be controlled in the hostile or hard to reach environment.

While there has been herein shown and described the presently preferred form of this invention, it is to be understood that such has been done for purposes of illustration only, and that various changes may be made therein within the scope of the appended claims.

What is claimed is:

1. A reciprocating switch assembly including:

(a) a tubular switch frame, the outer periphery of which comprises a plurality of support zones, (b) means separating said support zones for permitting a selected zone or zones to be knocked out to provide an opening (c) at least one electrical switch mounted on the periphery of said switch frame (d) said electrical switch including triggering means, a portion of which extends inwardly of said tubular switch frame (e) a reciprocating member movable in and out of said switch frame, and (f) at least one projection positioned on said reciprocating member in alignment with said triggering means, said projection engaging said triggering means when the reciprocating member is moved longitudinally of said tubular switch frame for activation by said projection to change the electrical state of said switch.

2. The reciprocating switch assembly of claim 1, wherein:

(a) said switch frame is formed from a waffle-like sheet of material including spaced, longitudinal and transverse weakened areas forming the plurality of support zones.

3. The assembly of claim 2, wherein:

(a) said waffle-like sheet of material is made of a non-conducting material.

4. The assembly of claim 3, with the addition of:

(a) a grid fitted over the waffle-like sheet of material and engaged with the weakened areas thereof.

5. The assembly of claim 1, wherein:

(a) each of said support zones is provided with a mounting hole.

6. The assembly of claim 5, with the addition of:

(a) securing means for connecting said electrical switch to selected mounting holes of the support zones.

7. The assembly of claim 1, wherein:

(a) said reciprocating member includes a cylindrical body portion (b) at least one triggering hump extending outwardly from the periphery of said body portion for engaging said triggering means of said electrical switch when said reciprocating member is moved longitudinally into said frame, and (c) means for securing said triggering hump to the periphery of said body portion.

8. The assembly of claim 7, wherein:

(a) said triggering hump comprises an elongated body of predetermined length and depth, the ends thereof being tapered downwardly to the surface of the elongated body.

9. The assembly of claim 7, with the addition of:

(a) alignment means for preventing relative rotational movement of said tubular switch frame with respect to said reciprocating member to maintain the alignment of said triggering means and said triggering hump.

10. The assembly of claim 9, wherein:

(a) said alignment means includes a plurality of spaced, longitudinally extending guide fins fixed to the outer periphery of said reciprocating member.

(b) said tubular switch frame being provided with a plurality of spaced, longitudinal channels in which said guide fins are positioned.

11. The assembly of claim 1, with the addition of:

(a) an outer housing over said tubular switch frame and reciprocating member (b) said outer housing including a central tubular member (c) end caps engaged with the terminals of said tubular member, and (d) means for engaging said outer housing with said switch frame and reciprocating member.

12. The assembly of claim 11, wherein:

(a) one of said end caps is provided with a hub portion of reduced size having internal threads (b) one end of said switch frame being threaded for engagement with the threads of said hub portion.

13. The assembly of claim 11, wherein:

(a) the opposite end of said switch frame is provided with a stopper, and (b) the outermost end of said reciprocating member being provided with a rear stopper, said rear stopper abutting against one of said end caps when said reciprocating member is fully withdrawn from said switch frame, and engageable with said stopper of the switch frame when fully inserted into said switch frame.

14. The assembly of claim 11, with the addition of:

(a) gasket means on said end caps for effecting a seal between said tubular member and said end caps.

15. The assembly of claim 11, wherein:

(a) one of said end caps is provided with circumferentially spaced holes to admit electric wires (b) sealing members in said holes through which the electric wires pass, and (c) sealing plugs engaged with the holes which are not in use.

16. The assembly of claim 11, with the addition of:

(a) a plunger arm connected to the outer end of said reciprocating member and extending through one of said end caps of the outer housing (b) a casing for said plunger arm connected to said housing, and (c) spring means within said casing engageable with said plunger arm for normally urging the latter to an inoperative position.

17. The assembly of claim 16, with the addition of:

(a) a plurality of spaced grooves on the periphery of said plunger arm (b) a stationary ball and detent positioned adjacent said plunger arm, said ball being selectively engaged with said grooves.

(c) spring means engaged with said ball, and (d) means for urging said spring means against said ball for forcing said ball in the direction of the grooves.

18. A reciprocating switch assembly including:

(a) a tubular switch frame, the outer periphery of which comprises a plurality of support zones separated by weakened areas to permit a selected zone or zones to be knocked out to provide an opening, (b) at least one electrical switch positioned on the periphery of said switch frame, a portion of said electrical switch protruding through said opening and inwardly of said tubular switch frame, (c) means for affixing said electrical switch to said tubular switch frame, (d) a key-like finger of tubular construction slidable within said switch frame, (e) at least one triggering hump positioned on the periphery of said key-like finger and aligned with the portion of said switch which protrudes through the switch frame opening, and (f) means for attaching said triggering hump to said key-like finger, whereby, when said key-like finger is moved longitudinally of said switch frame, the triggering hump engages the portion of the switch protruding through to activate the switch and change the electrical state thereof.

19. The assembly of claim 18, wherein:

(a) the support zones of said switch frame and the periphery of said key-like finger are provided with mounting holes, and (b) said means for affixing said electrical switch to said switch frame and said means for attaching said triggering hump to said key-like finger comprise bolts engageable with said switch and triggering hump, and threadedly engaged with the mounting holes of said switch frame and key-like finger.

20. The assembly of claim 18, with the addition of (a) an outer housing over said switch frame and said key-like finger, (b) said outer housing including a central tubular member, (c) end caps engaged with the terminals of said tubular member, and (d) gasket means on said end caps for effecting a seal between said tubular member and said end caps.

21. The assembly of claim 18, wherein:

(a) a plurality of electrical switches are mounted on said switch frame and a plurality of triggering humps are mounted on said key-like member.

22. The assembly of claim 18, wherein:

(a) said electrical switch is a micro-switch.

23. The assembly of claim 18, wherein:

(a) said electrical switch is a blade switch.

24. The assembly of claim 23, wherein:

(a) said blade switch includes spaced, opposed contact leaves, (b) contacts on each of said leaves in opposed relation.

(c) insulating means for holding said leaves in spaced relation, (d) one of said leaves including a fixed portion and a movable portion, (e) hinge means connecting said fixed portion to said movable portion, and (f) roller means carried by said movable portion and extending through the opening of said switch frame for engagement with said triggering hump to deflect said movable portion and effect engagement of said opposed contacts.

25. The assembly of claim 18, with the addition of:

(a) a plunger arm extending from an end of said key-like finger, (b) a portion of the periphery of said plunger arm being provided with a plurality of longitudinally spaced grooves, (c) stationary ball and detent positioned adjacent said plunger arm, said ball being adapted to selectively engage the grooves of said plunger arm, (d) a spring means engaged with said ball, and (e) a bolt threadedly engaged with said detent for urging said spring means against said ball for forcing said ball in the direction of the grooves, (f) said bolt being adjustable to selectively effect free sliding movement, fixed engagement of the plunger arm with respect to the switch frame and ratcheting movement of the plunger arm as the key-like finger moves longitudinally of said switch frame.

* * * * *